United States Patent [19]

Pfeifer

[11] 4,426,009

[45] Jan. 17, 1984

[54] SYSTEM FOR POSITIONING CONTAINERIZED MERCHANDISE ON A SHELF

[76] Inventor: Thomas E. Pfeifer, 3129 Calle Abajo, Space 111, San Diego, Calif. 92139

[21] Appl. No.: 228,373

[22] Filed: Jan. 26, 1981

[51] Int. Cl.[3] ..... A47F 5/00

[52] U.S. Cl. ..... 211/86; 108/61; 211/184; 217/7

[58] Field of Search ..... 211/86, 43, 184; 312/140.4, 9; 220/22.3, 22, 22.6; 206/443; 217/7, 10; 108/60, 61

[56] References Cited

U.S. PATENT DOCUMENTS

| | | | |
|---|---|---|---|
| 898,170 | 9/1908 | Barber | 217/10 |
| 989,566 | 4/1911 | Callaghan | 108/61 |
| 1,046,488 | 12/1912 | Pauley | 108/61 |
| 1,325,537 | 12/1919 | Ringler | 217/7 X |
| 1,698,946 | 1/1929 | Edgren | 108/61 |
| 2,685,372 | 8/1954 | Palaith . | |
| 2,933,195 | 4/1960 | Radek . | |
| 3,202,290 | 8/1965 | Harvey | 211/184 X |
| 3,212,755 | 10/1965 | Liss et al. | 312/140.4 X |
| 4,195,732 | 4/1980 | Bell | 206/443 X |

FOREIGN PATENT DOCUMENTS

| | | | |
|---|---|---|---|
| 659105 | 3/1938 | Fed. Rep. of Germany | 217/7 |

*Primary Examiner*—William E. Lyddane
*Assistant Examiner*—Peter A. Aschenbrenner
*Attorney, Agent, or Firm*—Brown & Martin

[57] ABSTRACT

A system for positioning uniformly sized containers such as canned or boxed merchandise in longitudinally extending rows on a laterally extending display shelf adjacent a wall. A spacing member extends laterally on top of the shelf removed from the wall. The spacing member may have a plurality of arcuate recesses formed in the front face thereof for receiving and aligning a row of cans. A plurality of laterally spaced support members are utilized to hold the spacing member in an upright position. The support members each have one end inserted into a space between the rear edge of the shelf and the wall and another end engaged with the spacing member. The support members are dimensioned so that a longitudinally extending row of a predetermined number of abutting containers will substantially extend between the front edge of the shelf and the spacing member. The system allows quick and efficient stocking of containerized merchandise on the front portion of the shelf. It eliminates the conventional practice of utilizing cans or boxes in the rear of the shelf as spacers to support a plurality of rows on the forward portion of the shelf. The amount of hidden merchandise is reduced and losses due to longer than shelf life storage are minimized.

7 Claims, 10 Drawing Figures

SYSTEM FOR POSITIONING CONTAINERIZED MERCHANDISE ON A SHELF

BACKGROUND OF THE INVENTION

The present invention relates to apparatus for the display of merchandise in supermarkets and the like, and more particularly to a system which allows quick and efficient positioning of canned or boxed goods on the front portion of the shelf while eliminating the conventional practice of utilizing several cans or boxes in the rear to support and face the forwardmost rows of goods.

Heretofore, the arraying and supplementing of goods on shelves in a supermarket, department store or the like has presented a number of problems. For example, in a supermarket canned goods must be loaded onto a shelf and arranged in neat rows. Due to the significant depth of the typical shelf, there is a tendency for goods to be sold starting from the front portion of the shelf. Typically, goods remain unsold and shelved for long periods of time at the innermost portions of the shelf. In order to eliminate this, supermarket clerks have utilized individual cans as spacers for positioning a few rows of cans which are to be sold toward the forwardmost portion of the shelf. This arrangement is time consuming to establish and makes replentishing of the cans more tedious. Frequently, the cans which are utilized as spacers represent a loss of inventory, and multiplied over hundred of shelves, this can represent a substantial economic loss. Such loss results when canned goods are utilized as spacers until expiration of the date past which they cannot be sold under law.

U.S. Pat. No. 4,136,783 of Karashima discloses a merchandising system in which rearwardly inclined surfaces are utilized on the display shelves so that as goods are removed from the front portion of the shelf, goods at the rearward portion of the shelf displace forwardly under the action of gravity. A significant amount of apparatus is required. There is a possibility that the forwardmost cans may become pinched against the forward rail of the shelf making them difficult to remove.

U.S. Pat. No. 2,685,372 of Palaith discloses a grocery store commodity shelf which rests upon a conventional shelf. The commodity shelf has an extensible forward portion which serves to support canned or boxed goods forward of adjacent conventional shelves for drawing attention thereto. It appears that goods are positioned and stored on the commodity shelf all the way to the rear wall of the conventional shelf.

U.S. Pat. No. 1,466,335 of Gleason discloses a tray adapted to support a plurality of boxed goods in a longitudinally extending row on a conventional shelf. The tray can apparently be slid forwardly to facilitate removal of one of the boxes. The tray is configured to permit lateral displacement of one of the boxes at the side of the tray during removal.

U.S. Pat. No. 2,933,195 of Radek discloses a shelf having a plurality of holes drilled therethrough for receiving the ends of the legs of a plurality of bent wire partition members. The partition members can be inserted at various locations to most advantageously divide the shelf into different storage compartments of different sizes to accommodate merchandise of different dimensions.

U.S. Pat. No. 3,908,563 of Eckart, Jr. discloses a shelving system for displaying cans of paint. Multiple color display panels are permanently hinged to the frontal edges of the shelves to indicate the color of the paint in the adjacent cans.

U.S. Pat. No. 3,640,389 of Snyder discloses a display stand including a base and a plurality of shelves supported on upright brackets. The shelves have horizontally extensible forward portions.

Finally, U.S. Pat. No. 1,983,187 of Oswell discloses a vertical rack for a lunch counter which holds condiments in position. The rack which includes a pair of vertical support posts which are inserted into slots formed by straps attached to the rear edge of the counter.

SUMMARY OF THE INVENTION

The primary object of the present invention is to provide a system for positioning containerized goods in aligned rows at the forward portion of a display shelf.

Another object of the present invention is to provide a system of the aforementioned type which will permit the depth of a standard display shelf to be readily reduced so that a given number of cans or boxes of any particular uniform size will fit from the front edge to the boundary.

It is a further object of the present invention to provide a system for rapidly stocking the forwardmost portions of display shelves which will eliminate the practice of utilizing canned or boxed goods as spacers.

It is yet another object of the present invention to provide a system of the aforementioned type which will accommodate cans and boxes of different sizes.

Still another object of the present invention is to provide a system for positioning containerized goods on display shelves which will decrease the time needed for price changes.

Still another object of the present invention is to provide a system for positioning merchandise on display shelves which will decrease the time needed for price changes.

Still another object of the present invention is to provide a system for positioning merchandise on display shelves which will reduce the amount of hidden merchandise.

Another object of the present invention is to provide a system for positioning containerized goods on a shelf having the aforementioned advantages which is durable, has a minimum number of parts, and is easy to install and replace.

The present invention provides a system for positioning uniformly sized containers such as canned or boxed merchandise in longitudinally extending rows on a laterally extending display shelf adjacent a wall. A spacing member extends laterally on top of the shelf removed from the wall. The spacing member may have a plurality of arcuate recesses formed in the front face thereof for receiving and aligning a row of cans. A plurality of laterally spaced support members are utilized to hold the spacing member in an upright position. The support members each have one end inserted into a space between the rear edge of the shelf and the wall and another end engaged with the spacing member. The support members are dimensioned so that a longitudinally extending row of a predetermined number of abutting containers will substantially extend between the front edge of the shelf and the spacing member. The system allows quick and efficient stocking of containerized merchandise on the front portion of the shelf. It eliminates the conventional practice of utilizing cans or boxes in the rear of the shelf as spacers to support a plurality of rows on the forward portion of the shelf. The amount of hidden merchandise is reduced and losses due to longer than shelf life storage are minimized.

BRIEF DESCRIPTION OF THE DRAWINGS

Throughout the figures, like reference numerals refer to like parts unless otherwise indicated.

DESCRIPTION OF THE PREFERRED EMBODIMENTS

Figure 6:
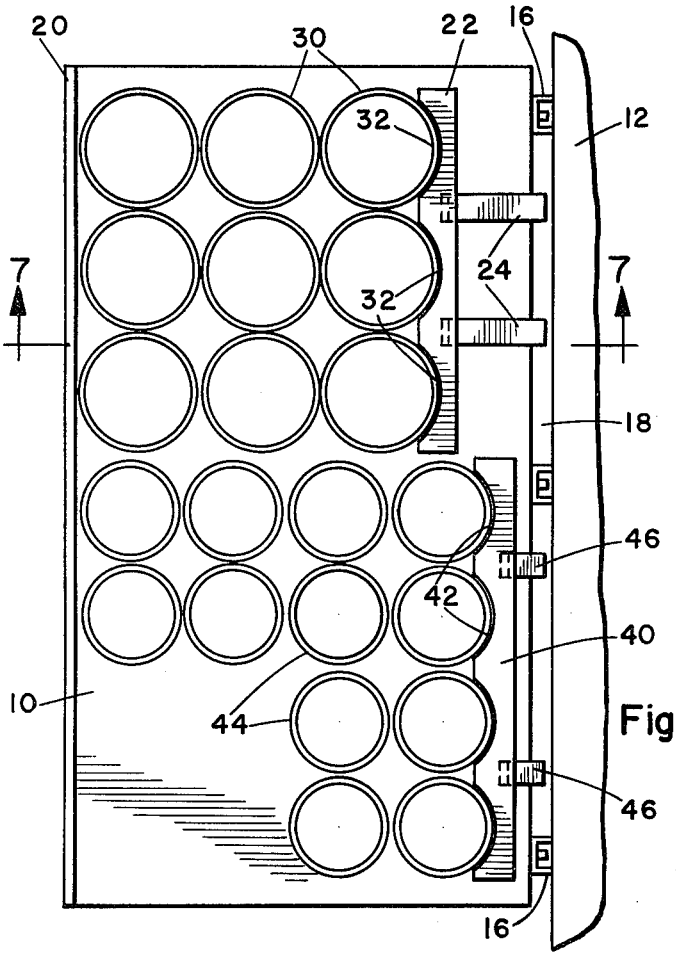
FIG. 6 is a top plan view of a typical arrangement of cans on a shelf fitted with two spacing members and a plurality of different sizes of support members for accommodating different can sizes.
Figure 7:
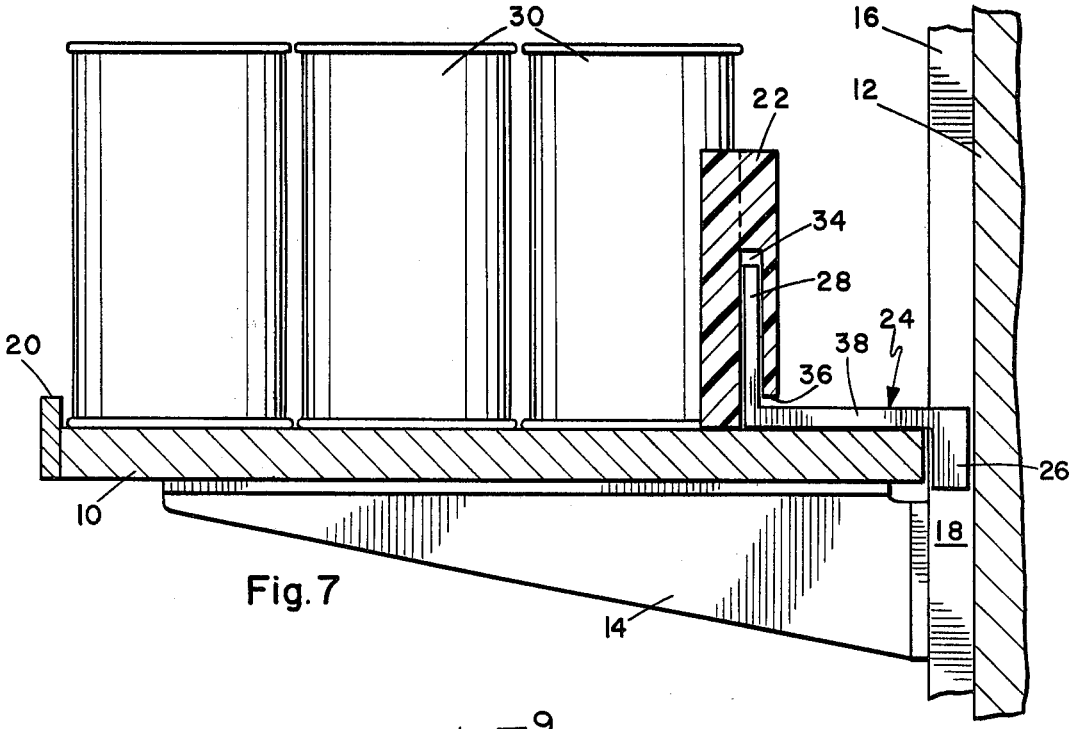
FIG. 7 is an enlarged sectional view taken along line 7—7 of FIG. 6.

By way of summary, the system of the present invention is adapted to be utilized in conjunction with a conventional display shelf in a supermarket, department store, or the like which includes a laterally extending horizontal shelf 10 (FIGS. 6 and 7) supported adjacent a vertical wall 12 (FIG. 7). The shelf 10 is supported by brackets such as 14 (FIG. 7) which are hooked into slots in vertical posts such as 16 secured to the wall 12. This conventional manner of supporting s shelf results in a laterally extending space 18 (FIG. 6) between the rear edge of the shelf 10 and the wall 12. The front edge of the shelf is provided with a lip or guard rail 20 (FIG. 7) which serves to prevent merchandise from sliding forwardly off of the shelf onto the floor.

The system of the present invention includes a spacing member 22 (FIG. 1) which is placed on top of the shelf 10 at a predetermined location so that it extends laterally across the same as shown in FIGS. 6 and 7. The system further includes a plurality of support members 24 (FIG. 2) which are installed on the shelf at laterally spaced locations as shown in FIG. 6. As best seen in FIG. 7, each of the support members has one end in the form of a rearward leg 26 inserted in the space 18 between the rear edge of the shelf 10 and the wall 12. Each of the support members further has its other end in the form of a forward leg 28 engaged with the spacing member 22 to hold the spacing member in an upright position at a predetermined depth on top of the shelf 10.

The support members 24 (FIGS. 6 and 7) are dimensioned so that a longitudinally extending row of a predetermined number of uniformly sized abutting cans 30 will substantially extend between the front edge of the shelf and the spacing member 22.

The spacing member 22 (FIG. 1) has a plurality of laterally spaced, vertically extending arcuate recesses 32 formed in the front surface thereof for receiving the rearwardmost cans 30 of each of the longitudinally extending rows. The lateral spacing of the recesses 32 is such that each may receive a can 30 simultaneously so that the cans will be aligned in a laterally extending row. The radius of the arcuate recesses 32 preferably matches the radius of the outer can walls so that the cans will snugly fit into the recesses. Where the system is to be utilized in connection with stocking boxed merchandise on a shelf, the arcuate recesses are not necessary and may be replaced with rectangular recesses appropriately dimensioned to snugly receive the boxes and align them in a lateral row.

Figure 1:
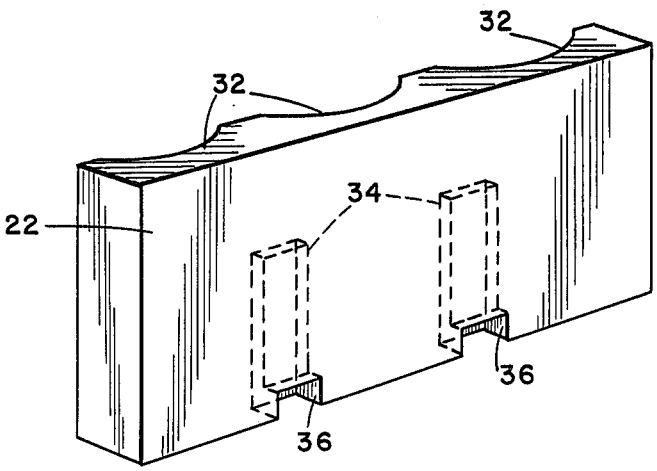
FIG. 1 is a perspective view of one form of a spacing member utilized in the system.
Figure 2:
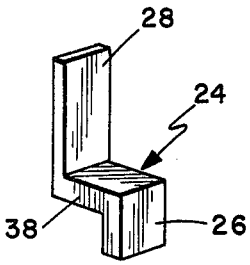
FIG. 2 is a perspective view of one form of a support member utilized in the system for holding the spacing member upright on the shelf at a predetermined depth.

The spacing member 22 has a plurality of laterally spaced sockets 34 shown in phantom lines in FIG. 1. Each of the sockets extends vertically within the spacing member and terminates at the lower edge thereof in a rearwardly opening slot 36. As shown in FIG. 2, the rearward and forward legs 26 and 28 of the support member 24 each extend perpendicular from the intermediate leg 38 in opposite direction. The legs 26, 28 and 38 have a rectangular configuration. As best seen in FIG. 7, each of the support members 24 has its rearward leg 26 inserted downwardly in the space 18 between the rear edge of the shelf 10 and the wall 12. The intermediate leg 38 of the support member extends horizontally along the top of the shelf and through the slot 36 of the spacing member 22. The forward leg 28 of the support member is inserted into and extends vertically within the socket 34. Thus, the support members serve to hold the spacing member 22. in an upright position so that it forms an artificial rear wall for the shelf.

By providing different support members having intermediate legs 38 (FIG. 7) of varying lengths, the depth of the spacing member 22 can be selected so that a row of a predetermined number of cans or boxes of a particular uniform size will just fill the space between the front edge of the shelf and the spacing member. As shown in FIGS. 1, 6 and 7, preferably the sockets 34 are formed in the spacing member 22 between the recesses 32. In the embodiment illustrated in FIGS. 1, 6 and 7, the forward wall of the socket 34 is approximately in longitudinal alignment with the rearwardmost portion of the adjacent recesses 32. This arrangement permits the spacing member 22 to be relatively thin while still allowing a support member leg of relatively large dimension and strength to be internally inserted into the spacing member.

Referring again to FIG. 6, the shelf 10 is also provided with a second spacing member 40 having a similar configuration to the spacing member 22 except that the arcuate recesses 42 of the spacing member 40 have a smaller radius to accept smaller cans 44. The second spacing member extends laterally on top of the shelf to one side of the other spacing member 22. A second plurality of laterally spaced support members 46 hold the spacing member 40 in an upright position on the shelf in the same manner as the support members 24. The intermediate legs of the second plurality of support members 46 are shorter than those of the support members 24 in order to position the second spacing member 40 rearward of the spacing member 22. This permits a predetermined number of abutting cans 44 having a uniform size different than that of the cans 30 to be stocked on the shelf 10 in longitudinally extending rows which substantially extend between the front edge of the shelf and the spacing member 40.

It can thus be seen that the system of the present invention allows the depth of a conventional display shelf to be rapidly adjusted. In the embodiment illustrated in FIGS. 6 and 7, the device facilitates quick and efficient stocking of cans in neat rows on the front portion of the shelf. It eliminates the conventional practice of utilizing several cans in the rear of the shelf to support and space rows of merchandise at the forward portion of the shelf. Furthermore, "hidden" merchandise is reduced and thus a lesser amount of merchandise must be discarded because its sale date deadline printed on the label has expired. Furthermore, restocking of the shelves and repricing of already shelved merchandise is facilitated because goods are loaded only onto the more accessible forward portion of the shelf.

Figure 3:
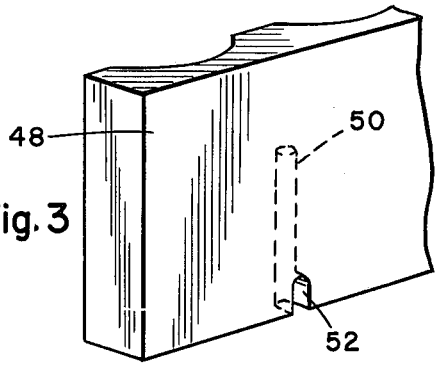
FIG. 3 is a perspective view of a portion of an alternate form of the spacing member.
Figure 4:
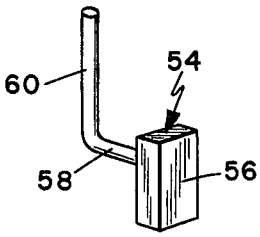
FIG. 4 is a perspective view of an alternate form of a support member which may be utilized in connection with the spacing member of FIG. 3.

The system of the present invention permits of modification in both arrangement and detail. For example, FIG. 3 depicts another form of a spacing member 48 wherein each of the sockets includes a cylindrical bore 50 shown in phantom lines which extends vertically within the spacing member and terminates at the lower edge of the spacing member in a rearwardly opening slot 52. FIG. 4 illustrates an alternate form of a support member 54 adapted for use with the spacing member 48 of FIG. 3. The support member 54 has a downwardly extending rearward leg 56 in the form of a rectangular block. The intermediate and forward legs 58 and 60 of this support member are formed from a rod which is bent at a ninety degree angle and connected to the rectangular block 56. The forward leg 60 is adapted to be snugly inserted into one of the bores 50.

Figure 5:
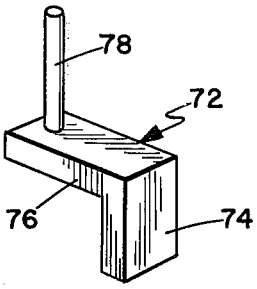
FIG. 5 is a perspective view of another form of the support member.
Figure 8:
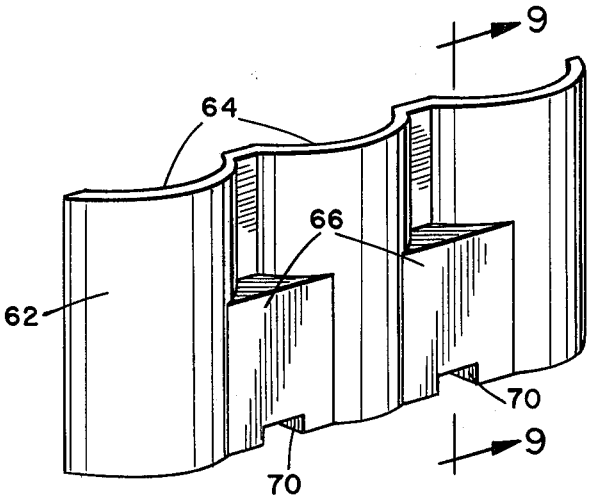
FIG. 8 is a perspective view of another form of the spacing member suitable for molded plastic construction.
Figure 9:
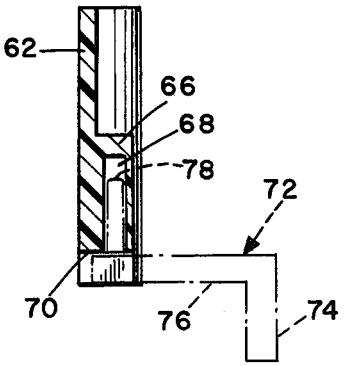
FIG. 9 is a vertical sectional view taken along line 9—9 of FIG. 8, with the support member of FIG. 5 indicated in phantom lines in engagement with the spacing member.

FIG. 8 shows another form of a spacing member 62 which comprises a thin planar member corrugated to define the plurality of arcuate recesses 64 for receiving cans. Attachment blocks 66 are integrally formed to the rear of the spacing member 62 between portions thereof defining the recesses 64. As shown in FIG. 9, each of the blocks 66 has a vertical bore 68 and a slot 70 formed therein. The spacing member 62 of FIG. 8 is adapted to be held in an upright position on the shelf utilizing another form of the support member 72 shown in FIG. 5. It includes rectangular rearward and intermediate legs 74 and 76 and a forward leg in the form of a vertical rod 78. As shown in FIG. 9, the rod 78 is inserted into the bore 68 of the block 66 and the intermediate leg 76 fits within the slot 70. The spacing member 62 illustrated in FIG. 8 may be molded of any suitable lightweight, durable, high strength plastic material.

Figure 10:
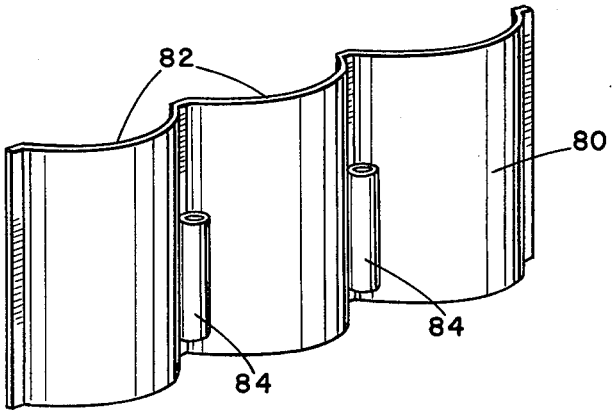
FIG. 10 is a perspective view of another form of spacing member suitable for sheet metal construction.

FIG. 10 illustrates another form of a spacing member 80 which may be formed by corrugating or bending a piece of sheet metal to produce the necessary recesses 82 for receiving cans. Tubular members 84 may be soldered, glued, or otherwise affixed to the rearward face of the spacing member 80 to define sockets for receiving the rod-like forward legs of support members such as 54 or 72 shown in FIGS. 4 and 5, respectively.

It should be understood that where the shelves do not have any space 18, the spacing member 22 may be utilized without any support members 24 where the shelf is shallow enough so that the rear side of the spacing member will abut against the wall 12. The spacing member still allows for rapid shelf stocking.

Having described a preferred embodiment of my system for positioning containerized merchandise on a display shelf as well as various modifications thereof, it should be apparent that further modifications will occur to those skilled in the art. Therefore, the protection afforded my invention should be limited only in accordance with the scope of the following claims:

I claim:

1. A system for positioning cans on a shelf extending adjacent a wall, comprising:

an elongate spacing member having formed therein a plurality of arcuate recesses spaced longitudinally along a front surface of the member for each receiving a can so that its cylindrical axis extends transverse to the longitudinal dimension of the spacing member and a plurality of sockets longitudinally spaced along the spacing member and extending transverse to the longitudinal dimension of the spacing member; and a plurality of support members each configured to provide a first end insertable in a corresponding one of the sockets and a second end engageable with a rear portion of a shelf upon which the spacing member may be placed to thereby hold the spacing member in position for receiving in its arcuate recesses a row of cans supported on their ends on the shelf.

2. A system according to claim 1 wherein each support member has a rear leg insertable in a space between a rear edge of the shelf and a wall, an intermediate leg extending from the rear leg to the spacing member, and a forward leg extending from the intermediate leg and insertable in one of the sockets in the spacing member.

3. A system according to claim 2 wherein the rearward leg and the forward leg of each of the support members extend perpendicular from the intermediate leg in opposite directions.

4. A system according to claim 2 wherein each of the sockets includes a cylindrical bore and the forward leg of each of the support members comprises a rod adapted to be snugly inserted into one of the bores.

5. A system according to claim 4 wherein each of the sockets is defined by a tubular member affixed to a rear surface of the spacing member.

6. A system according to claim 2 wherein each of the sockets in the spacing member is shaped to receive a portion of the intermediate leg of a support member.

7. A system according to claim 1 wherein the spacing member comprises a planar member corrugated to define the arcuate recesses.

* * * * *